United States Patent [19]

Rendahl

[11] Patent Number: 4,893,575

[45] Date of Patent: Jan. 16, 1990

[54] FANCY SEAM SEWING MACHINE WITH AN INFINITELY VARIABLE ZIGZAG MODULE

[75] Inventor: Karl I. F. Rendahl, Huskvarna, Sweden

[73] Assignee: Husqvarna Aktiebolag, Huskvarna, Sweden

[21] Appl. No.: 193,402

[22] Filed: May 12, 1988

[30] Foreign Application Priority Data

May 25, 1987 [SE] Sweden ..... 8702192

[51] Int. Cl.[4] ..... D05B 3/02

[52] U.S. Cl. ..... 112/465

[58] Field of Search ..... 112/465, 462, 463, 466

[56] References Cited

U.S. PATENT DOCUMENTS 3,693,563 9/1972 Kasuga ..... 112/465
4,134,351 1/1979 Giesselmann ..... 112/465 X
4,170,950 10/1979 Ozaki .
4,190,008 2/1980 Baruffa ..... 112/465 X
4,463,694 8/1984 Sano .

FOREIGN PATENT DOCUMENTS 142919 2/1981 Denmark .
1810788 8/1969 Fed. Rep. of Germany .

*Primary Examiner*—Andrew M. Falik
*Attorney, Agent, or Firm*—Pearne, Gordon, McCoy & Granger

[57] ABSTRACT

A fancy seam sewing machine has an infinitely variable zigzag module (47,51,58) which also includes a continuous setting of stitch positions in a stitch field between two outer positions of the needle. The arrangement includes a slide (51) in cooperation with a guide (58) and a setting device (48,49) for the slide as well as a driving unit (33,62) for an oscillatory movement of the guide. The slide has direct contact with the needle bar, which then carries out through the slide an arbitrarily set proportion of the said oscillatory movement.

3 Claims, 4 Drawing Sheets

FANCY SEAM SEWING MACHINE WITH AN INFINITELY VARIABLE ZIGZAG MODULE

BACKGROUND OF THE INVENTION

The present invention relates to a mechanical fancy seam sewing machine with a cam set for controlling needle and feeding movements.

For sewing complicated fancy seams, such sewing machines are provided with arrangements for automatic control of stitch width, stitch field and feeding. For setting the initial position of the stitch and the stitch field, the sewing machine is equipped with a manual control unit which possibly is a combination control (e.g., a double knob) used for setting of several fancy seams. As to the setting of the stitch width and the zigzag pattern, this is preferably made by a separate control. Such a mechanism for controlling positions and movements in respect to several different units in the machine required that all the interior space in the machine be occupied. Such a machine is described in detail, for example, in Swedish Patent Spec. SE-P-212 970. In more recent sewing machine production, the requirements for lightness and compact performance of the machine have been raised, and therefore the adjustable zigzag mechanism is now built together with the ordinary fancy seam mechanism. This earlier construction described in SE-P-7303690-7 is known for its cam set, gear head and cam follower, which by way of link arms produce and transmit lateral movements to the needle. The lateral movement performed by only a cam disk and links is proportionally simple to effect, but when adjustment and proportionality of such a simply effected movement are also required, the problem with the needle control becomes more complicated. However, it is possible to make the construction somewhat simpler if the stitch field positions only need to be used when sewing straight seams in those positions. As to zigzag sewing machines in general, there is a tendency for an impaired feeding exactness in the middle of the stitch field as the tooth rows of the feed dog are situated widely apart on these machines. A possibility for obtaining better feeding exactness is to locate the stitch formation to some of the outer positions in the stitch field, where at least one tooth row is situated.

SUMMARY OF THE INVENTION

According to the present invention, a fancy seam sewing machine has a cam disk unit rotatable with a driving shaft in the machine, and includes a cam selecting unit which is adjustable by a pattern selection control device relative to the cam disk unit. A movable guide is journalled for oscillatory movement by one of the cam disks and a sensor in the form of a slide in the control device is mounted for oscillatory and sliding movement in the plane of the oscillatory movement of the guide. The slide has a longitudinal slot or groove within which is mounted a pin carried on a bar connected to the needle bar unit. A zigzag control is continuously adjustable to move the slide longitudinally in the direction of the slot and in the plane of oscillatory movement relative to the guide to vary the amplitude of oscillatory movement of the slide, and hence the needle bar unit.

Another feature of the invention is the provision of a mechanism for adjusting the position of the guide during straight stitch sewing so that the guide remains stationary, and adjustable movement of the zigzag control and the resulting longitudinal movement of the slide will then move the pin and bar together with the needle bar unit to move the needle position laterally with respect to the center line.

An embodiment of the sewing machine with the fancy seam mechanism according to the invention is discussed in the following with reference to the attached drawings.

BRIEF DESCRIPTION OF THE DRAWINGS

FIG. 3 is a vertical projection, partially in section, of the fancy seam mechanism;

FIGS. 6–8 show different seam patterns.

DETAILED DESCRIPTION OF THE PREFERRED EMBODIMENT

Figure 1:
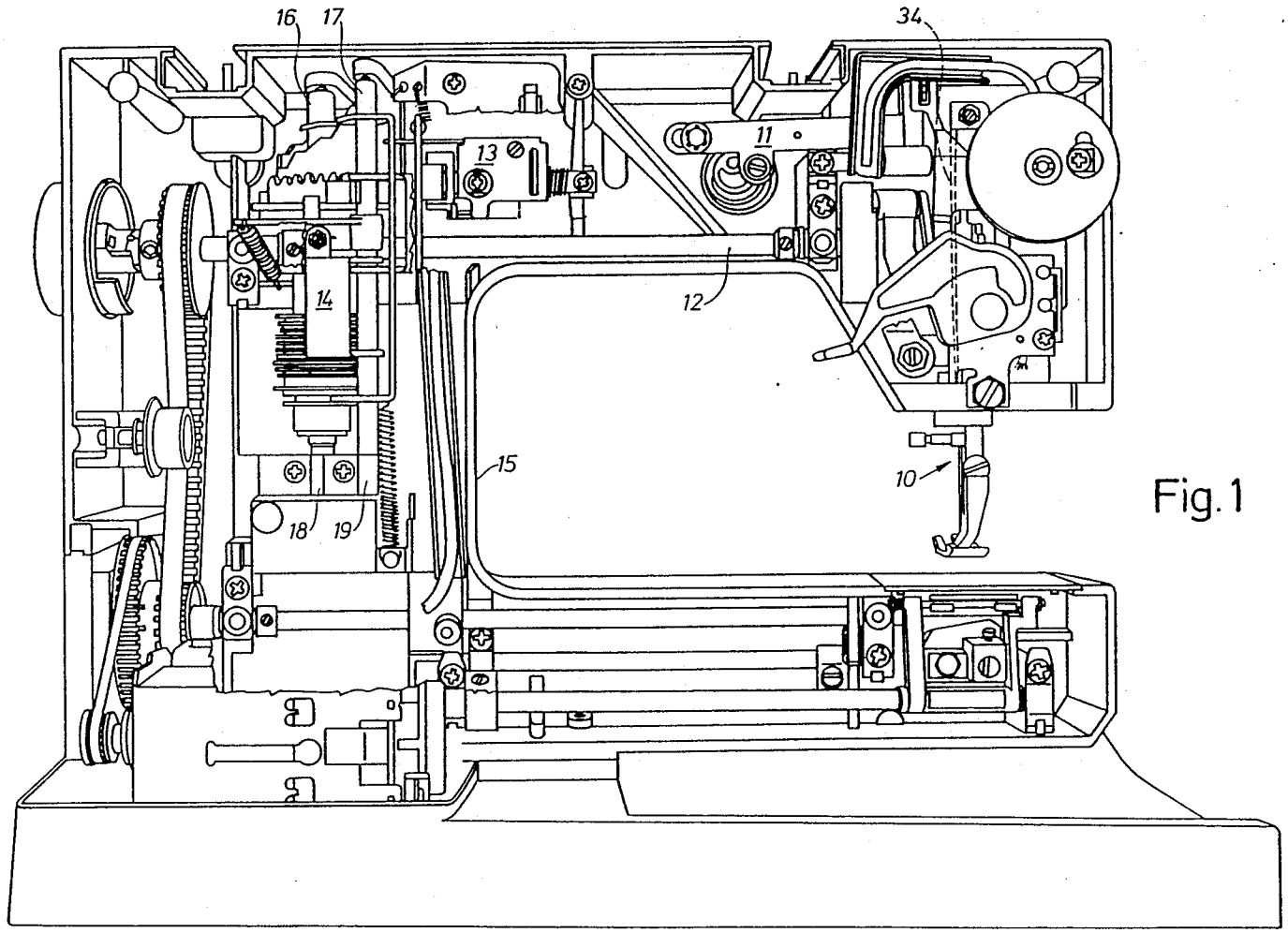
FIG. 1 is an elevational view of a sewing machine with the back removed.

With reference to FIG. 1. the sewing machine presented contains parts which are known in conventional sewing machines. Consequently, a presser bar and needle bar unit 10, a thread tension unit 11, an upper shaft 12, a stitch length unit 13, a zigzag control 14, as well as lower shafts and the shuttle mechanism, can be recognized. On the front side of the machine, there are control knobs with bearings in the front wall of the machine body. These knobs include control cams, cog wheels, pins, etc. to be found at the inside of the front wall. The zigzag control 14 is located in a pillar 15 of the body and attached with two firm shafts 16,17 included in the unit, whose upper ends are formed as pins and entered into holes in the top side of the body and having their lower ends attached with clamps 18,19 at the body.

With reference to FIGS. and 3, the setting of the zigzag control on different seams is effected with a control knob 20, which, by means of an angular gear train 21,22, is connected to a circular axial cam 23 which thus can be rotated around the shaft 16 by means of the knob. The cam is kept in firm position by a latch 24 which engages with recesses 25 in a co-rotating disk 26. The latch contains an arm 27 journalled in bearings and provided with a wedge-shaped tooth 28 going automatically into and out of the recesses during the rotation of the disk, due to the action of a spring 29 on the arm. On the shaft 16, there is also a cam disk unit 30, journalled and displaceable, and driven by an angular gear train 31, 32 that is driven by the upper shaft 12. The cam disks are scanned by a cam follower 33 which is journalled in bearings on the shaft 17 and tensioned against the cam disks by a plate spring 34 (see FIG. 1) of the needle bar unit. The vertical position of the cam disk unit on the shaft 16 is determined by the axial cam 23, which is funnel-shaped and scanned by a cam follower 35 which has at the bottom a bracket whose end is fit into a groove 37 lowest down in the cam disk unit and holding the unit at the height set. In order to make a vertical adjustment of the cam disk unit possible, a lifting of the cam follower out from the cam disks is necessary, however, and this movement is made by the arm 27, which, by way of a setscrew 38, influences a clamp 39 on which the cam follower is located. When the disk 26 rotates, the arm 27 is forced outward by the tooth 28 and the recess 25, so that the clamp and the cam follower move outward, after which the cam follower 35, with the bracket 30 and a downward acting spring 40, produce a vertical movement according to the shape of the axial cam, upward (by the curve) and downward (by the spring). At the top of the cam disk unit there is a cam disk 41 on a level with a second cam follower 42, which are used for control of the stitch length unit 13 (see FIG. 1) of the machine via a control arm 43. Furthermore, the shaft 17 supports a small clamp 44 which is revolving and has an outgoing arm 45 which supports a bar 46 whose outer end is fixed to the needle bar unit 10. The connection between the arm 45 and the cam follower 33 will now be described in more detail with reference to FIGS. 3–5.

Figure 2:
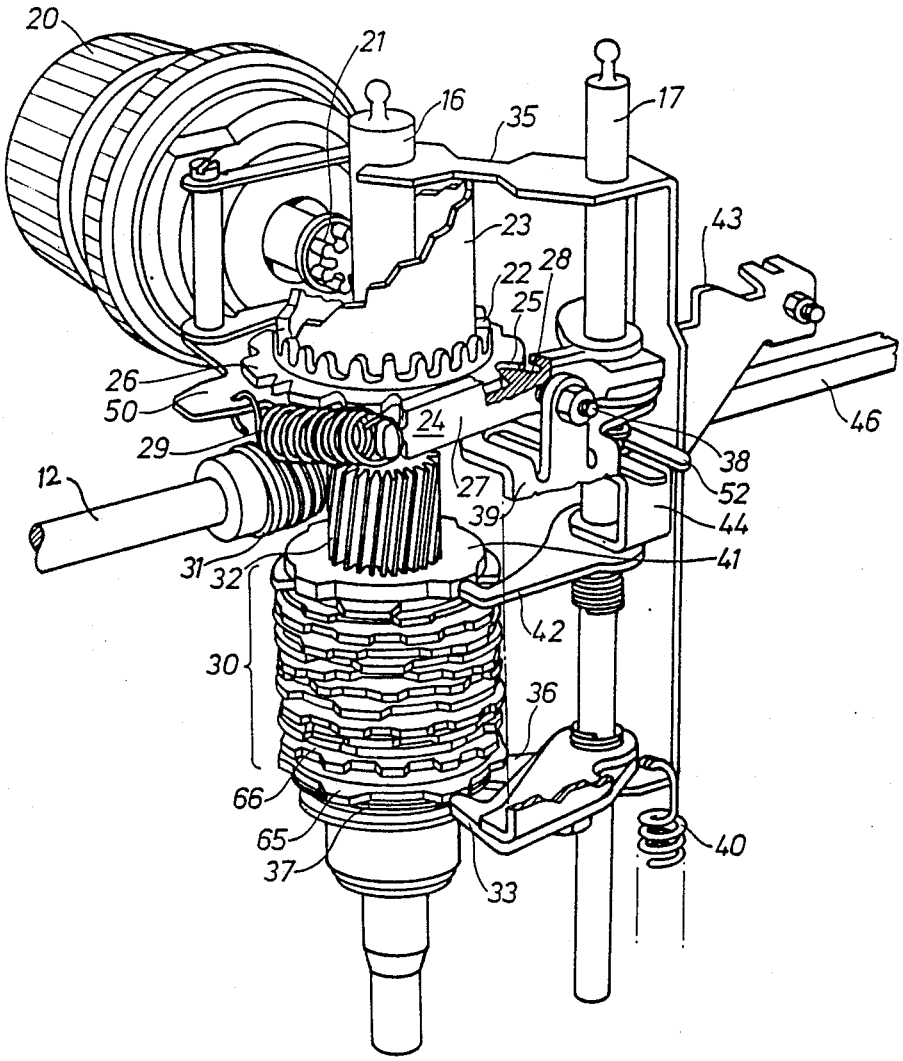
FIG. 2 is a perspective view of a fancy seam mechanism.
Figure 4:
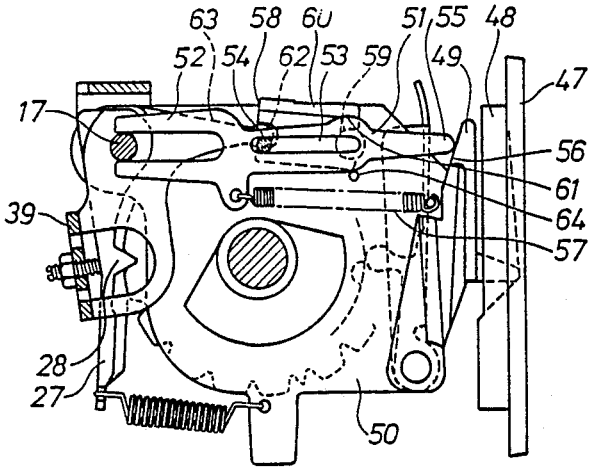
FIG. 4 is a detailed view on line IV—IV of FIG. 3, showing the mechanism in straight seam position.
Figure 5:
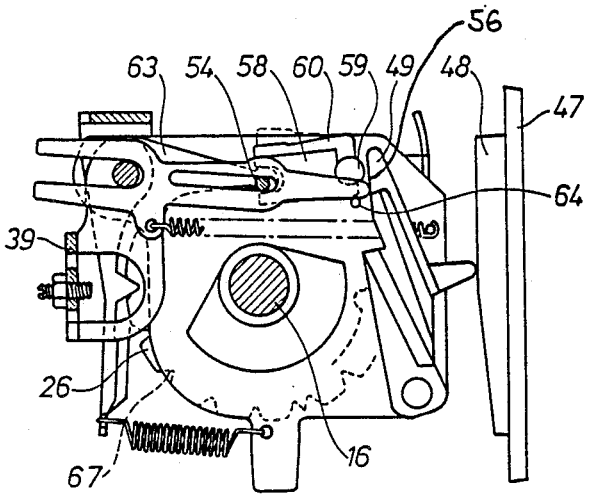
FIG. 5 is a view similar to FIG. 4, but in the zigzag position.

As evident from FIG. 3, the mechanism as shown therein contains a number of flat link elements between the knob 20 and the shaft 17. Inside the knob 20 there is a further knob 47 having an axial cam 48 which is scanned by a cam follower 49 journalled on a supporting plate 50. This cam follower is mechanically connected to a slide 51 which straddles with a fork 52 (also see FIG. 2) over the shaft 17 and has in the middle a groove 53 (see FIG. 4). In this groove there is a bearing pin 54 which, moreover, also unites the arm 45 and the bar 46. The slide can be moved in its longitudinal direction between two end positions which are illustrated in FIG. 4 and FIG. 5. The pin 54 is then at the one and at the other end, respectively, of the groove 53. The one end 55 of the slide is kept in contact with a sliding surface 56 of the cam follower, due to a screw spring 57 which is tensioned between points on the slide as well as on te supporting plate. Between those two, there is a space for a guide 58 journalled on a pin 59 (also see FIG. 3) projecting from the supporting plate. It has the shape of a short angle piece whose one flange 60 is extended over the slide, which then, via a projection 61 on the same, is in a direct connection with the guide. This one has, in its turn, connection by means of a toggle joint 62 with an arm 63 emanating from the clamp 39 by way of a bearing on the shaft 17. The spring 57 is tensioned from a point at the side of the slide, which always causes the projection 61 to be pressed against the flange 60. To the supporting plate there is also fixed a stop pin 64 preventing the end 55 of the slide from moving off the sliding surface 56 (FIG. 5) when being mounted or assembled, as well as during a possible blocking, for instance, from the needle bar.

The axial curve 48 has such a shape that the slide 51 is moved from the position in FIG. 4 to the position in FIG. 5 when the curve is rotated about one revolution. If the guide is situated as in FIG. 5 (solid-line position), the slide end 55 will slide on the surface 56 from the center to one of the borders close to the pin 64. Then the pin 54 is moved closer to the shaft 16, causing the needle to be moved to the left in FIG. 1. This needle position can then be used for straight stitches or constitute a width limit for the zigzag stitches of the machine.

The zigzag seam sewn by the machine when set as in FIG. 5 is symmetrical around a center line in the stitch field and is obtained from a cam disk 65 (see FIG. 2) in the unit. This disk has cams all around which lift the cam follower 33 so that the guide, every second revolution of the machine, is in the solid-line position as to FIG. 5 and, in other revolutions, in the dashed-line position. The pin 54 will then swing between the outer positions, i.e., make an oscillatory movement in FIG. 5, which movement is passed on to the needle bar by the bar 46. By means of the knob 47 and the curve 48, the amplitude of the movement can be set on an arbitrary value so that a picture according to FIG. 6 is obtained when the knob is rotated from the maximum value of zigzag to zero. During this setting movement of the knob 47, the slide 51 is moved from the position in FIG. 5 to that in FIG. 4 and the said oscillatory movement of the pin 54 is decreased successively.

When sewing a zigzag seam, the guide must be free to operate as indicated in the foregoing. When making firm stitch positions in the stitch field, however, the guide should be fixed to the dashed-line or the solid-line position of FIG. 5. When sewing those stitches, the cam follower 33 is put on a cam disk 66 (see FIG. 2) with a low, smooth profile which does not guide the needle bar. The setting of the guide takes place by means of the latch 24, the disk 26, and the spring 34. As to the position according to FIG. 4 (dashed lines in FIG. 5), the spring 34 determines that the needle bar is positioned to the right of the center line according to FIG. 8. The stitches shown there are obtained when the slide 51 is pushed from one of its end positions to the other. The solid-line position shown in FIG. 5 can be fixed by means of the latch 24, whose arm 27 is swung out when the curve 23 is rotated and prevents, by way of the screw 38, the clamp 39 from being drawn against the shaft 16. The tooth 28 located in a lower recess 67 (see FIG. 5) thus constitutes the setting of the needle in the left end position of the stitch field. The stitches which can be sewn in this position are shown in FIG. 7, which thus indicates a continuously variable distance from the center line, which distance is set, as in the foregoing, by means of the knob 47 and the curve 48, the slide 51 thus sliding along the immobile guide. In order to make the stitches in FIG. 7 instead of the stitches in FIG. 8, it is thus necessary to make a separate setting of the knob 20 so that the recess 25 is moved from the tooth 28 and the recess 67 takes that position instead. The basic setting of the knob 47 and the curve 48 is that shown in FIG. 5, as the guide then can freely transfer the movements effected by the cam follower to the slide, and consequently to the needle bar. The knob, however, has a scale which can be used for recommended settings of all controls on the machine. Each control has an indicator showing the value recommended, and as far as the knob 47 is concerned, the indicator consists of, for example, a tape with figures fed by the fancy seam selector 20 and read through a window in the panel. However, such an indicator system is not described in this specification but is more closely explained in another Swedish patent Spec. SE-A-8702191-1.

What is claimed is:

1. In a fancy seam sewing machine with a zigzag control arrangement for producing fancy seams, said machine having a cam disk unit (30) rotatable with a driving shaft provided in the machine, an elastic member (34) influenced cam selecting unit (33) which, by means of a pattern selection control device (20) is adjustable relative to the cam disk unit and connectable to cam disks in said cam disk unit as well as connected to a guide (58) journalled in the control device for carrying out an oscillatory movement effected by one of said cam disks, and a sensor (51) included in the control device and cooperating with the guide and journalled in bearings for oscillatory and sliding movements and connected to a needle bar unit (10) of the machine, the improvement wherein the sensor comprises a slide with extension and displaceability within the same plane as said oscillatory movement of the guide and continuously adjustable in its longitudinal direction by means of a zigzag control (47) on any position relative to the guide to transfer an arbitrary amplitude of said oscillatory movement to the slide and therefrom to the needle bar unit.

2. A fancy seam sewing machine according to claim 1 wherein the pattern control (20) includes at least two settings for fixed guide positions, the first setting affecting the right position of the needle in the stitch field of the machine by means of a latch (24) completely setting the cam selecting unit into an outermost position, and the second setting affecting the left position of the needle by means of the elastic member (34) setting the cam selecting unit in a position completely opposite to this outermost position.

3. A fancy seam sewing machine according to claim 2 wherein the slide is an elongated plate moveable in the plane of the plate to perform oscillatory movements effected by said guide and provided with means for transferring said movements to the needle bar unit, and receiving adjustment movements from the zigzag control and return movements from a spring member (57).

* * * * *

UNITED STATES PATENT AND TRADEMARK OFFICE

CERTIFICATE OF CORRECTION

PATENT NO. : 4,893,575

DATED : January 16, 1990

INVENTOR(S) : Karl I. F. Rendahl

It is certified that error appears in the above-identified patent and that said Letters Patent is hereby corrected as shown below:

Column 3, line 34, delete "te" and insert --the--.

Column 4, line 59, after"(20)" insert --,--.

Column 4, line 67, after "machine" insert --said needle bar unit being movable between right and left needle positions by said zigzag control--.

Column 4, line 68, after "a" insert --longitudinally extending--.

Column 5, line 3, after "direction" insert --relative to the guides--.

Column 5, line 4, after "(47)" delete "on any position relative to the guide to transfer an arbitrary amplitude of said oscillatory movement to the slide and therefrom to the needle bar unit." and insert --to transfer a predetermined amplitude of said oscillatory movement to the slide and therefrom to the needle bar unit.--

Column 5, line 10, delete "affect-" and insert --effect--.

Column 6, line 1, delete "affecting" and insert --effecting--.

Column 6, line 3, delete "this" and insert --said--.

Column 6, line 6, delete "moveable" and insert --movable--.

UNITED STATES PATENT AND TRADEMARK OFFICE

CERTIFICATE OF CORRECTION

PATENT NO. : 4,893,575

DATED : January 16, 1990

INVENTOR(S) : Karl I. F. Rendahl

It is certified that error appears in the above-identified patent and that said Letters Patent is hereby corrected as shown below:

Col. 6, line 9, after "unit" delete "," and insert --.-- and delete "and receiving adjustment movements from the zigzag control and return movements from a spring member (57)."

Signed and Sealed this

Eighteenth Day of June, 1991

*Attest:*

*Attesting Officer*

HARRY F. MANBECK, JR.

*Commissioner of Patents and Trademarks*